United States Patent [19]

Abbott, Jr.

[11] Patent Number: 4,663,902

[45] Date of Patent: May 12, 1987

[54] FENCE POST ANCHOR

[76] Inventor: Lacey E. Abbott, Jr., 420 Alderman Rd., Lakeland, Fla. 33805

[21] Appl. No.: 856,467

[22] Filed: Apr. 28, 1986

Related U.S. Application Data

[63] Continuation of Ser. No. 598,963, Apr. 11, 1984, abandoned.

[51] Int. Cl.[4] ..... E02D 5/74

[52] U.S. Cl. ..... 52/155; 52/153

[58] Field of Search ..... 52/155, 153, 166, 169.13, 52/23, 26

[56] References Cited

U.S. PATENT DOCUMENTS 3,012,644 12/1961 Bush ..... 189/92

*Primary Examiner*—Carl D. Friedman
*Assistant Examiner*—Naoko N. Slack
*Attorney, Agent, or Firm*—Beaman & Beaman

[57] ABSTRACT

An anchor for fence posts consisting of a spade pivotally attached to a post wherein the configuration of the sheet metal spade generally corresponds to the post, and by the use of a strap the anchor may be retrofitted to an installed post and will pivot to an operable position to resist post tilting and withdrawal.

2 Claims, 7 Drawing Figures

FENCE POST ANCHOR

This is a continuation of application Ser. No. 06/598,963 filed Apr. 11, 1984 now abandond 5-8-86.

BACKGROUND OF THE INVENTION

Fence posts, particularly corner posts, often utilize subterranean anchoring devices to resist post withdrawal and tilting. It is known to utilize anchors which are pivotally mounted upon the post, and it is also known to pivotally associate the anchor with the post as shown in U.S. Pat. Nos. 744,421 and 3,866,368.

Also, it is sometimes desired to install an anchor upon a fence post after the post has been installed in the ground and has been in use. The need for the anchor may not appear until after a period of usage, and with conventional anchors it is often necessary to dig out the post, remove the fencing therefrom, remove the post, apply the anchor and reinstall the post and anchor.

A basic object of the invention is to provide a low cost fence post anchor of sheet metal usable with wood posts which effectively resists post withdrawal and tilting, and may be pivoted to an operative position.

It is an additional object of the invention to provide an anchor for fence posts which permits the anchor to be installed without removing the post from the ground.

Yet another object of the invention is to provide a fence post anchor of inexpensive construction which may be applied to the post above the ground, and will slide downwardly on the post without post removal to its operative location, and will automatically assume an operative condition.

In the practice of the invention the anchor consists of a sheet metal spade which is pivotally attached to a fence post. The spade is of a concave-convex configuration and the inner end of the spade is provided with a concave edge generally corresponding to the diameter of the post. Ears are defined upon the spade adjacent its inner end having holes by which the spade may be nailed to a post and if a flexible strap is used it is pivotally attached to the spade ears. A plurality of holes defined in the strap permit ready adjustment for various post sizes.

Usually, the anchor is pivotally attached to a wood fence post by nails extending through the ear holes. The shape of the spade substantially conforms to the post shape and the anchor can be pivoted adjacent the post to permit entrance into the post hole. Pivoting of the anchor outwardly to its operative position engages the inner edge of the anchor with the post to maintain the anchor in its final position.

If the anchor is to be attached to an installed post a strap is attached to the spade, and after the earth about the post has been partially removed, the anchor slides down the post to the desired location. The spade may then be pivoted outwardly to its operative position, and the concave spade edge automatically engages the post to limit further spade pivoting and locate the spade in its operative condition. The clearance about the post is refilled, and the anchor installation is completed.

The concave-convex configuration of the spade permits sheet metal to have sufficient strength to withstand high forces as imposed upon the anchor, yet the sheet metal construction of the spade and strap assures economy and facilitates shipping. Installation is simple and requires no special skills or tools.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
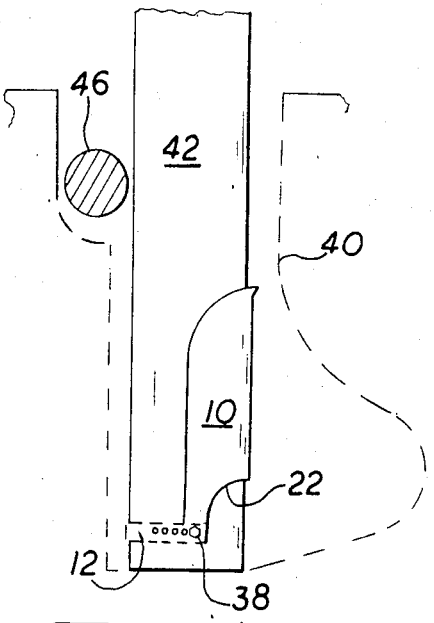
Fig. 1 is an elevational, sectional view of a fence post having an anchor in accord with the invention installed thereon prior to pivoting of the anchor spade to the operative condition, a strap being shown in dotted lines.

A fence post anchor in accord with the invention basicall consists of a spade 10. The spade 10 is formed of sheet metal, such as galvanized steel or the like, but if desired, the spade could be formed of a high strength synthetic plastic material, or the like. The flattened configuration of the spade will be appreciated from FIG. 6 wherein it is apparent that the spade is of an elongated configuration having parallel lateral sides 14, an outer end 16 which is preferably of a convex configuration and may be bent downwardly at 18 to facilitate opening. The spade includes an inner end 20 partially defined by the concave inner edge 22 which is of a lesser diameter than the width separating the lateral sides 14 whereby ears 24 are formed on each side of the concave edge, and pivot pin holes 26 are defined in the ears.

Figure 6:
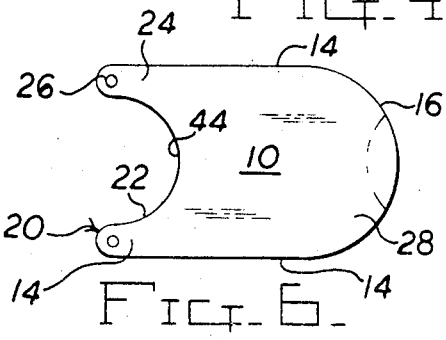
FIG. 6 is a plan view of the flattened shape of the spade as used for large diameter posts.

The flattened shape of FIG. 6 is bent into a convex-concave configuration wherein the spade upper side 28 will be concave about an axis parallel to the spade length, while the bottom surface 30 is convex.

When using the anchor with installed posts, the strap 12 is used. The post encircling flexible metal strap 12 has ends 34, and a plurality of holes 36 are spaced along the strap adjacent each end wherein pivot pins, such as bolts 38, may be used to pivotally attach the strap to the spade 10 through the holes 36 and 26, and the plurality of holes 36 permits strap length adjustment to accommodate different post diameters.

In use, the spade 10 is nailed to the lower region of the post by nails extending through the holes 26. The spade is curved to conform to the post and positioned and located as apparent in FIG. 1. The post 42 is placed in the hole and by means of a shovel or the like is pivoted to the position of FIG. 2 wherein apex 44 engages the post and prevents further pivoting. In its operative position of FIG. 2 the spade effectively resists post withdrawal and tilting.

When the anchor is to be employed with a post 42 that is already in place, the post may be temporarily anchored at its upper region to prevent the fence tension from tilting the post, and the earth surrounding the post, or at least a portion thereof, is cleared and removed to form a cavity 40, FIG. 1. Thereupon, the strap 12 is attached to the spade 10 and adjusted with respect to the spade to accommodate the post diameter and the spade is placed upon the upper region of the post in the manner apparent in FIG. 1, and the anchor is pushed downwardly on the post 42 to the position of FIG. 1. Thereupon, the spade 10 is pivoted in a clockwise direction to the position of FIG. 2.

Figure 2:
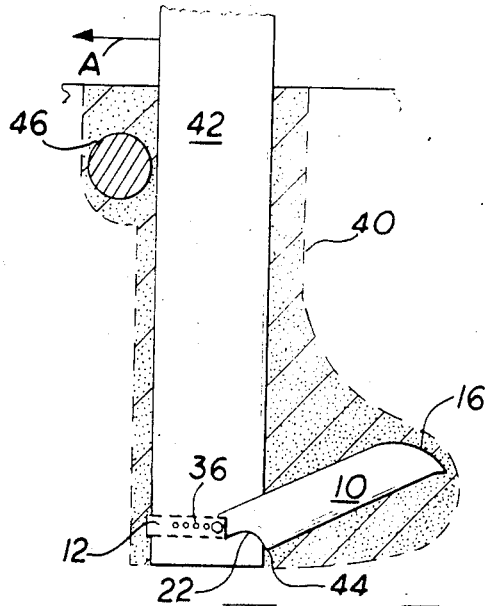
Fig. 2 is an elevational, sectional view similar to FIG. 1 illustrating the spade in the operative condition.
Figure 3:
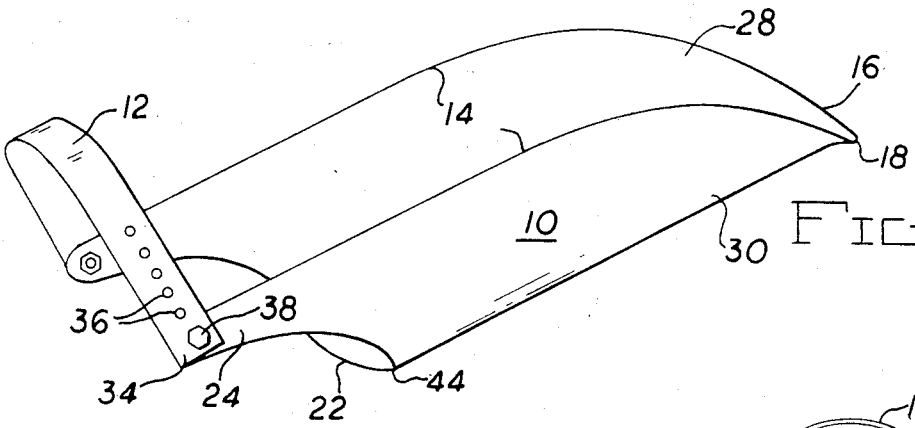
Fig. 3 is an perspective view of the anchor assembly having a strap attached thereto.
Figure 4:
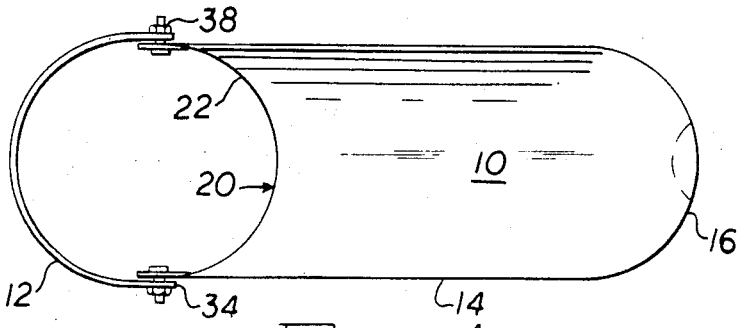
Fig. 4 is a top view of the anchor assembly with a strap in accord with the invention.
Figure 5:
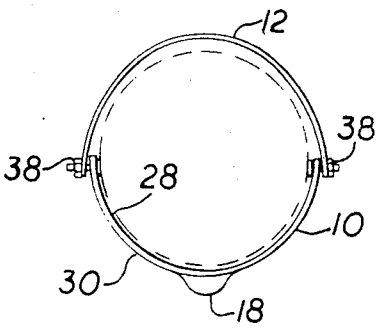
Fig. 5 is a top view of the anchor when positioned as as in FIG. 1, the post being shown in dotted lines and a strap being shown in full lines.

In the position of FIG. 2 the apex 44 of the concave edge 22 will engage the post 42, and as the ears 24 are located upon the opposite sides of the post, the apex 44 serves as an abutment to prevent further clockwise rotation of the spade. Thereupon, the hole may be refilled and tamped and installation is completed.

Fence posts requiring anchors are normally corner posts, and the general direction of tension on the posts is represented by the arrow A in FIG. 2. The installation of the anchor 10 will prevent the post from lifting, and it is usually desirable to install a horizontally disposed "dead man" post 46 as shown in FIGS. 1 and 2 to serve as a fulcrum when using the anchor to further resist post tilting.

Figure 7:
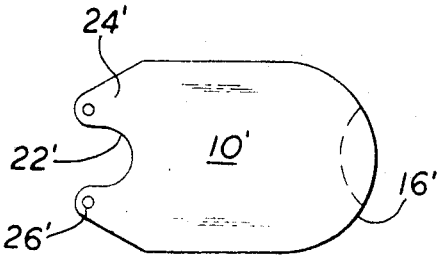
Fig. 7 is a plan view of the flattened shape of the spade as used with small diameter posts such as of steel or synthetic plastic.

The anchor of the invention may be used with steel or synthetic plastic posts which are usually of a smaller diameter than wood posts by using a strap, and in such instance an anchor configuration such as shown in FIG. 7 is normally employed. The anchor configuration of FIG. 7 is similar to that described with respect to FIG. 6 and primed reference numerals are utilized for identical components. As the diameter of the concave edge 22' is less than that of edge 22 the ears 24' will have a slightly different configuration, but the assembly, installation and operation is identical to that described above.

If the soil is particularly firm, has a high clay content, or is rocky, a spade of shorter length may be employed in the practice of the invention without detracting from the efficiency of the anchor.

From the aforegoing description it will be appreciated that a fence post anchor in accord with the invention is of a low cost, readily manufacturable, and concise with respect to storage and shipping. As the pivoting of the spade from the position of FIG. 1 to that of FIG. 2 automatically engages the edge 22 with the post to limit spade movement, the spade will automatically function as desired once the spade is pivoted as shown in FIG. 2.

It is appreciated that various modifications to the inventive concepts may be apparent to those skilled in the art without departing from the spirit and scope of the invention.

I claim:

1. A fence post anchor comprising, in combination, an elongated space having an axis, upper and lower surfaces, lateral side edges, and inner and outer ends, said space having a transverse upper surface concave-lower surface convex cross section, a concave edge centrally defined on said spade inner end with respect to said axis and of a lesser transverse dimension than the circumferential dimension separating said lateral side edges adjacent said inner end, said concave edge including an apex adjacent said axis, elongated axially extending ears defined upon said spade adjacent said inner end by said concave edge and said lateral edges, a hole defined in each ear adjacent said spade inner end and axially spaced from apex in a direction away from said spade outer end, an elongated flexible post strap having ends, and pivot means connecting a strap end to an ear hole to pivotally attach said strap to said spade.

2. In a fence post anchor as in claim 1, said strap including a plurality of holes adjacent said strap ends spaced in the direction of the strap length, said pivot means being selectively located within said strap holes.

* * * * *